United States Patent [19]

Jones, deceased et al.

[11] Patent Number: 4,529,388

[45] Date of Patent: Jul. 16, 1985

[54] MOORING BUOY

[76] Inventors: Arthur P. Jones, deceased, late of New York, N.Y.; by Francine V. Pirrone, executor; by Arthur A. Jones, executor; George Spector, all of 3615 Woolworth Bldg., 233 Broadway, New York, N.Y. 10007

[21] Appl. No.: 384,095

[22] Filed: Jun. 1, 1982

[51] Int. Cl.[3] ..... B63B 21/52

[52] U.S. Cl. ..... 441/3; 114/230

[58] Field of Search ..... 114/230; 441/1, 3, 6, 441/11

[56] References Cited

U.S. PATENT DOCUMENTS

| | | | |
|---|---|---|---|
| 2,680,859 | 6/1954 | Hultberg | 441/3 |
| 2,996,033 | 8/1961 | Yordi | 114/230 |
| 3,077,614 | 2/1963 | Lloyd | 114/230 X |

FOREIGN PATENT DOCUMENTS

| | | | |
|---|---|---|---|
| 1426638 | 3/1976 | United Kingdom | 441/1 |

*Primary Examiner*—Sherman D. Basinger

[57] ABSTRACT

A mooring buoy including an upwardly mast made of two sections with a spring therebetween, a large ring on a top of the upper section, and the spring permitting the upper section to be tilted over sidewardly.

1 Claim, 3 Drawing Figures

MOORING BUOY

This invention relates generally to anchor mooring buoys such as to which a small boat ties up in order to be prevented from drifting away.

It is well known to those persons acquainted with the particular field, that when a boat is being brought to a mooring buoy, the conventional practice is for the deck hand to use a boat hook in order to pick up the pennant line at the buoy. This can be difficult especially from a larger boat where the deck hand must reach further in order to pick it up. This situation is objectionable and is therefore in need of an improvement.

Therefore it is a principal object of the present invention to provide a means whereby the pennant line is held up outof the water and is also sidewardly presented so to be readily reached by a hand alone, without need of a boat hookman which is easier then fishing it out of the water.

Another object is to provide a buoy in which the pennant line is hung on an upright mast mounted upon the buoy, and an so that the hung up pennant line is at an elevation convenient to a person standing on the boat to reach, and wherein the upper end of the mast flys a small flag at an easily visible height for a boat in a crowded harbor looking for its own mooring.

Figure 1:
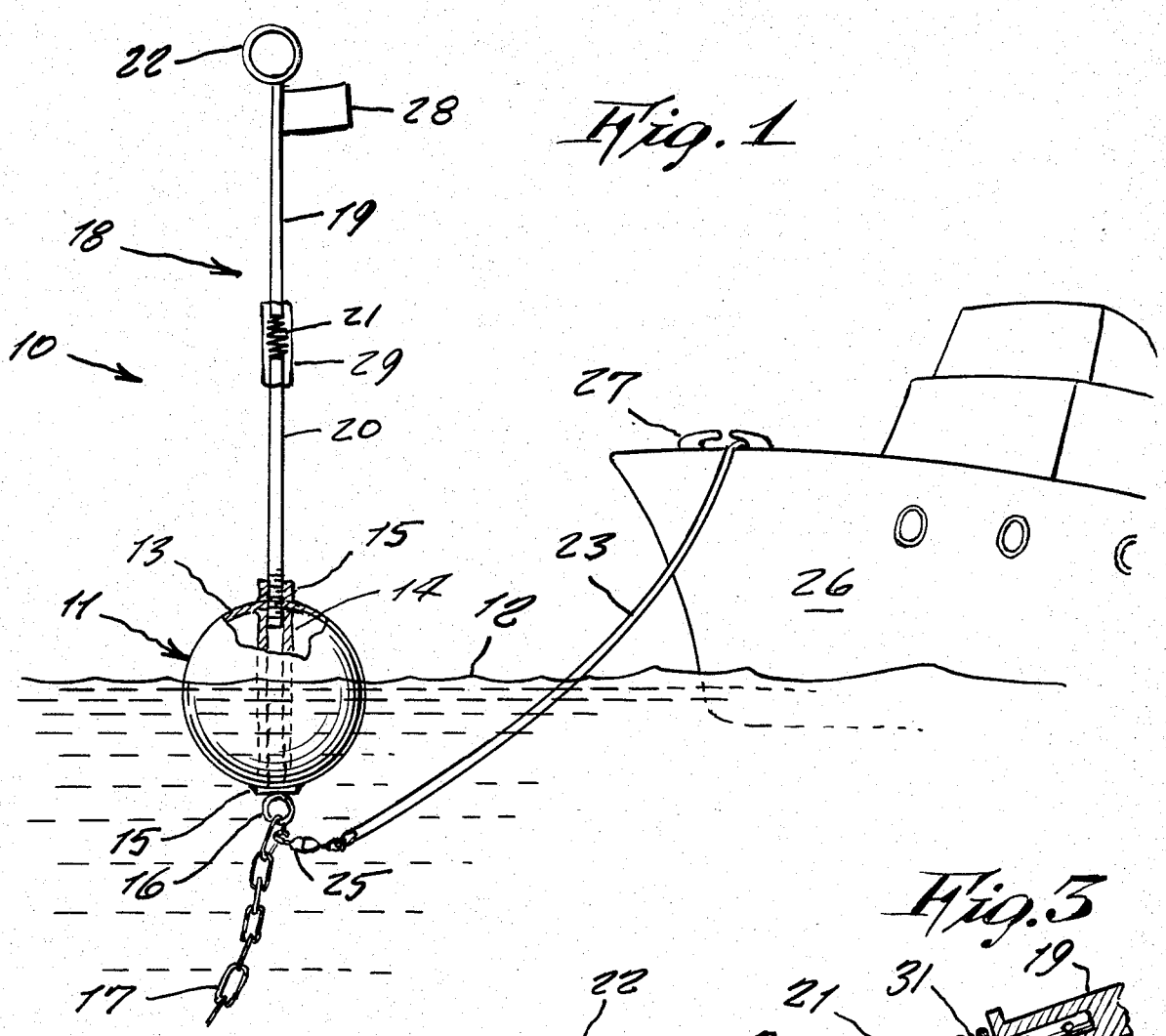
FIG. 1 is a side view of the invention in use, mooring a boat.
Figure 2:
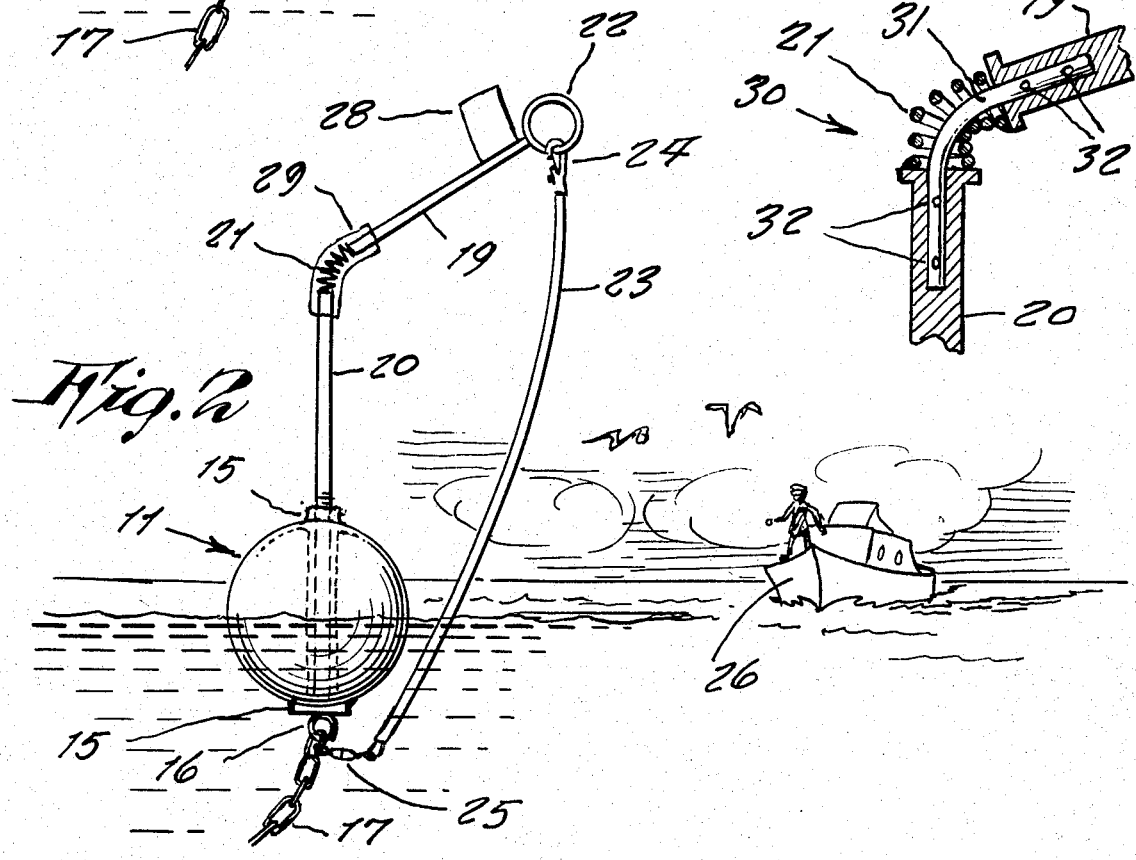
FIG. 2 is a similar view thereof when not in use, but ready for being grasped by a person on a boat coming to the mooring.

Referring now to the drawing in greater detail, and more particularly to FIGS. 1 and 2 thereof at this time, the reference numeral 10 represents a mooring buoy according to the present invention wherein there is a hollow mooring can 11 for floating upon a water surface 12, and which is preferably made of a strong metal shell 13 including a threaded diametrically extending sleeve 14 made integrally therethrough. An outwardly flange 15 at each end of the sleeve is also screw threaded.

A lower of the threaded flanges has an eye bolt 16 screwed therein, and to which the anchor chain 17 is permanently connected.

A mast 18 is screwed in the upper flange, the mast being made of upper and lower mast sections 19 and 20 connected to ends of a stainless steel circular spring 21 located therebetween. The mast sections are made either of fiberglass or also of a stainless steel. An upper end of the upper section is made with a five inch diameter, metal ring 22 standing fixedly upright thereupon, and to which a pennant line 23 can be removably attached by means of a snap hook 24 on an end of the pennant line. The opposite end of the pennant line is permanently connected to the eye bolt 16 by means of a swivel 25. The pennant line comprises a chain sheathed inside a flexible plastic sleeve so to be strong for securing a boat and at a same time be comfortable for being handled in a persons hand.

The weight of the pennant line is such so that when attached to the ring 22, it causes the mast upper section to bend over about the flexible spring 21, as shown in FIG. 2, whereby the pennant line thus hangs sidewardly away from above the mooring can, so to be easily reached by a hand of a person on a boat, without need of the boat getting too close to the mooring can and getting the boat hull scratched thereupon. The pennant line, thus picked up, can then be attached to the boat 26 by extending through the anchor line chock 27, as shown in FIG. 1.

A flag 28 attached near an upper end of the mast upper section, aids a person to locate the buoy from a distance away.

A neoprene sleeve 29 around the spring 21 protects it from weathering, salt water, and the like.

Figure 3:
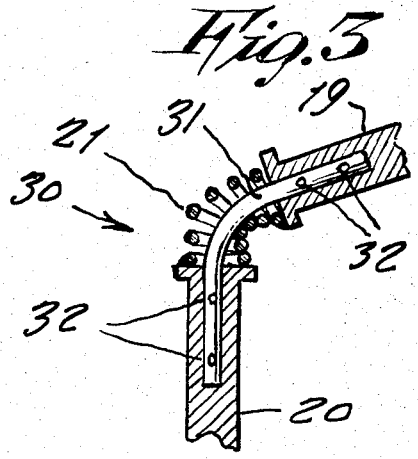
FIG. 3 show an enlarged cross sectional view of a modified design of the spring joint and which includes a flexible shaft therewithin so to limit the distance of flexibility of the joint and prevent the top to hang down too far or into the water.

In a modified design 30 shown in FIG. 3, a flexible shaft 31 extends through a center of the spring 21 and is secured in each mast section by means of cross pins 32, while the ends of the spring abut against the ends of the mast sections. Thus, as shown in FIG. 3, this construction limits the distance to which the spring can be bent over without damage thereto, such as during rough weather.

While various changes may be made in the detail construction, it is understood that such changes will be within the spirit and scope of the present invention as is defined by the appended claims.

What is claimed:

1. A buoy assembly comprising in combination a hollow buoy having a sleeve integrally therethrough, an outward flange at each end, an eye bolt threaded in the lower of said flanges for attachment to an anchor chain and to one end of a pennant line, and a mast threaded in an upper of said flanges, said mast being comprised of upper and lower sections with a coil spring therebetween whereby the upper section pivots, a flag and a ring at a top of said upper section and means for limiting pivotal bending of said upper section wherein said means comprises a flexible shaft secured to the lower section wherein said pennant line hooks to said ring on said mast upper section so as to bend said upper section sidewardly.

* * * * *